US007955146B1

(12) United States Patent
Wang et al.

(10) Patent No.: US 7,955,146 B1
(45) Date of Patent: Jun. 7, 2011

(54) ELECTRICAL CONNECTOR

(75) Inventors: Chin-Chou Wang, Taipei (TW); Sheng-Nan Yu, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/831,268

(22) Filed: Jul. 7, 2010

(51) Int. Cl.
*H01R 4/48* (2006.01)

(52) U.S. Cl. ..... 439/862; 439/733.1

(58) Field of Classification Search ..... 439/500, 439/733.1, 744, 746, 862
See application file for complete search history.

(56) References Cited

U.S. PATENT DOCUMENTS 5,865,648 A * 2/1999 Clyatt, III ..... 439/620.09
6,511,329 B2 * 1/2003 Yi-Tsung ..... 439/76.1
6,805,595 B2 * 10/2004 Kukita et al. ..... 439/862
7,278,892 B1 * 10/2007 Chien et al. ..... 439/862
7,775,805 B2 * 8/2010 Liao et al. ..... 439/66
7,803,011 B1 * 9/2010 Mai ..... 439/500
7,833,069 B2 * 11/2010 Wu et al. ..... 439/862

* cited by examiner

*Primary Examiner* — Thanh-Tam T Le

(57) ABSTRACT

An electrical connector adapted to be mounted to an electronic product which has two first locating blocks each defining a first containing mouth between two arms of the first locating block, and two second locating blocks each defining a second containing mouth between two arms of the second locating block. The electrical connector includes an insulating housing and a plurality of terminals. The insulating housing defines a plurality of terminal passages. The insulating housing has two opposite end surfaces which oppositely protrude outward to form two connecting blocks. A front of each of the connecting blocks is positioned in the first containing mouth and a rear of each of the connecting blocks is positioned in the second containing mouth so that the connecting block can be clipped between the first locating block and the corresponding second locating block. The terminals are received in the terminal passages, respectively.

4 Claims, 5 Drawing Sheets

ELECTRICAL CONNECTOR

BACKGROUND OF THE INVENTION

1. Field of the Invention

The present invention generally relates to an electrical connector, and more particularly to an electrical connector with a fastening structure capable of being assembled to an electronic product directly.

2. The Related Art

Generally, a conventional electrical connector adapted to be mounted in an electronic product includes an insulating housing and a plurality of terminals. The insulating housing defines a plurality of terminal passages for receiving the terminals therein. Each of the terminals has a base board for electrically connecting with the electronic product, an elastic portion connected with a middle of one end edge of the base board, and a contact portion bent from a free end of the elastic portion. The electrical connector is fastened to the electronic product, such as a cell phone, by means of using a surface mounting technology so that on one hand can make the electrical connector fastened to the electronic product, and on the other hand can provide an electrical connection between the electrical connector and the electronic product.

However, a sway of the terminal received in the terminal passage often accidentally happens, so that is apt to result in an unsteady electrical connection between the terminals and the electronic product. Furthermore, the surface mounting technology takes a high cost that results in a high assembly cost between the electrical connector and the electronic product.

SUMMARY OF THE INVENTION

An object of the present invention is to provide an electrical connector adapted to be mounted to an electronic product which has two lying L-shaped first locating blocks each defining a first containing mouth between two arms of the first locating block, and two reversed L-shaped second locating blocks each defining a second containing mouth between two arms of the second locating block. The first containing mouth substantially faces to the corresponding second containing mouth. The electrical connector includes an insulating housing and a plurality of terminals. The insulating housing defines a plurality of terminal passages of which each includes a receiving groove at a front thereof. A propping portion are protruded upward from a rear of a bottom face of the receiving groove and spaced from a rear wall of the terminal passage to define an inserting groove therebetween. The insulating housing has two opposite end surfaces which oppositely protrude outward to form two lying L-shaped connecting blocks. A front of each of the connecting blocks is positioned in the first containing mouth and a rear of each of the connecting blocks is positioned in the second containing mouth so that the connecting block can be clipped between the first locating block and the corresponding second locating block to make the electrical connector mounted to the electronic product. The terminals are received in the terminal passages of the insulating housing respectively. Each terminal has a base board, a substantially V-shaped elastic portion of which one arm is connected with a top edge of the base board and apart faces to the base board, and a contact portion arched upward from a free end of the other arm of the elastic portion. The elastic portion is received in the receiving groove. The base board is inserted in the inserting groove to electrically connect with the electronic product. The propping portion is located between the base board and the elastic portion.

As described above, the base board is inserted in the inserting groove and the buckling protrusions are buckled in the buckling fillisters so that prevent the base board swaying and further firmly restrain the terminal in the insulating housing. Furthermore, the electrical connector is firmly assembled to the electronic product directly by means of clipping the connecting block between the first locating block and the corresponding second locating block. As a result, it simplifies an assembly process of the electrical connector and the electronic product, and further lowers an assembly cost of the electrical connector.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENT

Figure 1:
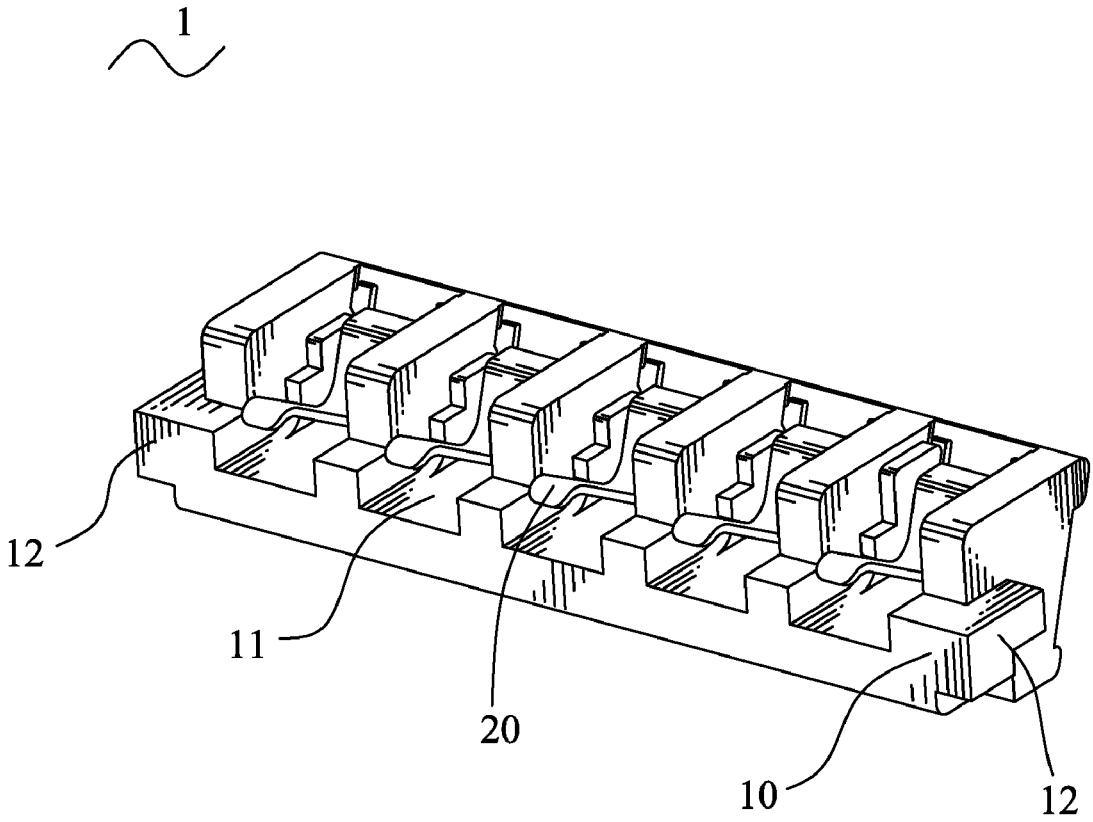
FIG. 1 is a perspective view of an electrical connector according to the present invention.
Figure 2:
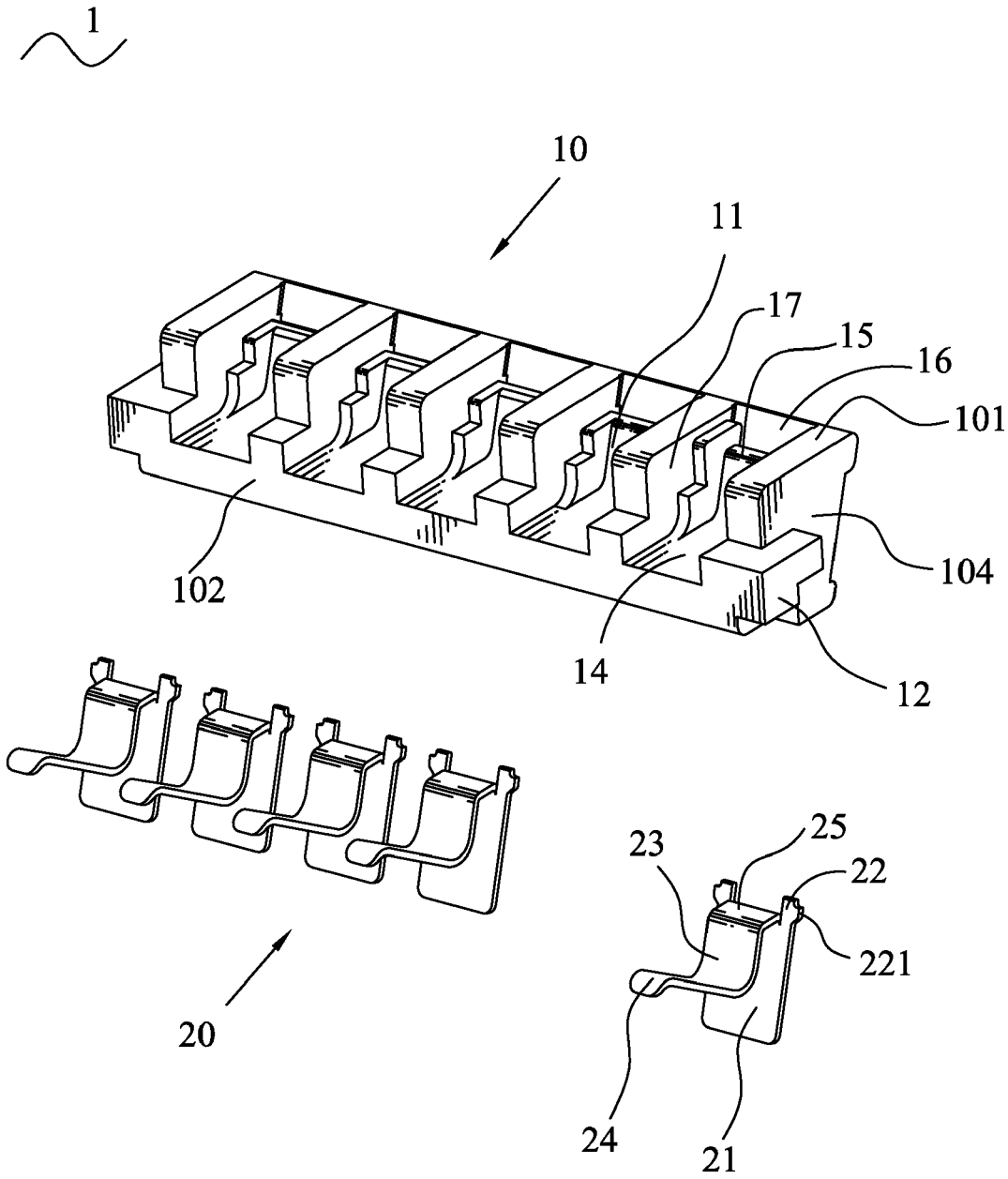
FIG. 2 is an exploded perspective view of the electrical connector of FIG. 1.

Referring to FIG. 1 and FIG. 2, an electrical connector 1 in accordance with the present invention includes an insulating housing 10 and a plurality of terminals 20 received in the insulating housing 10.

Figure 3:
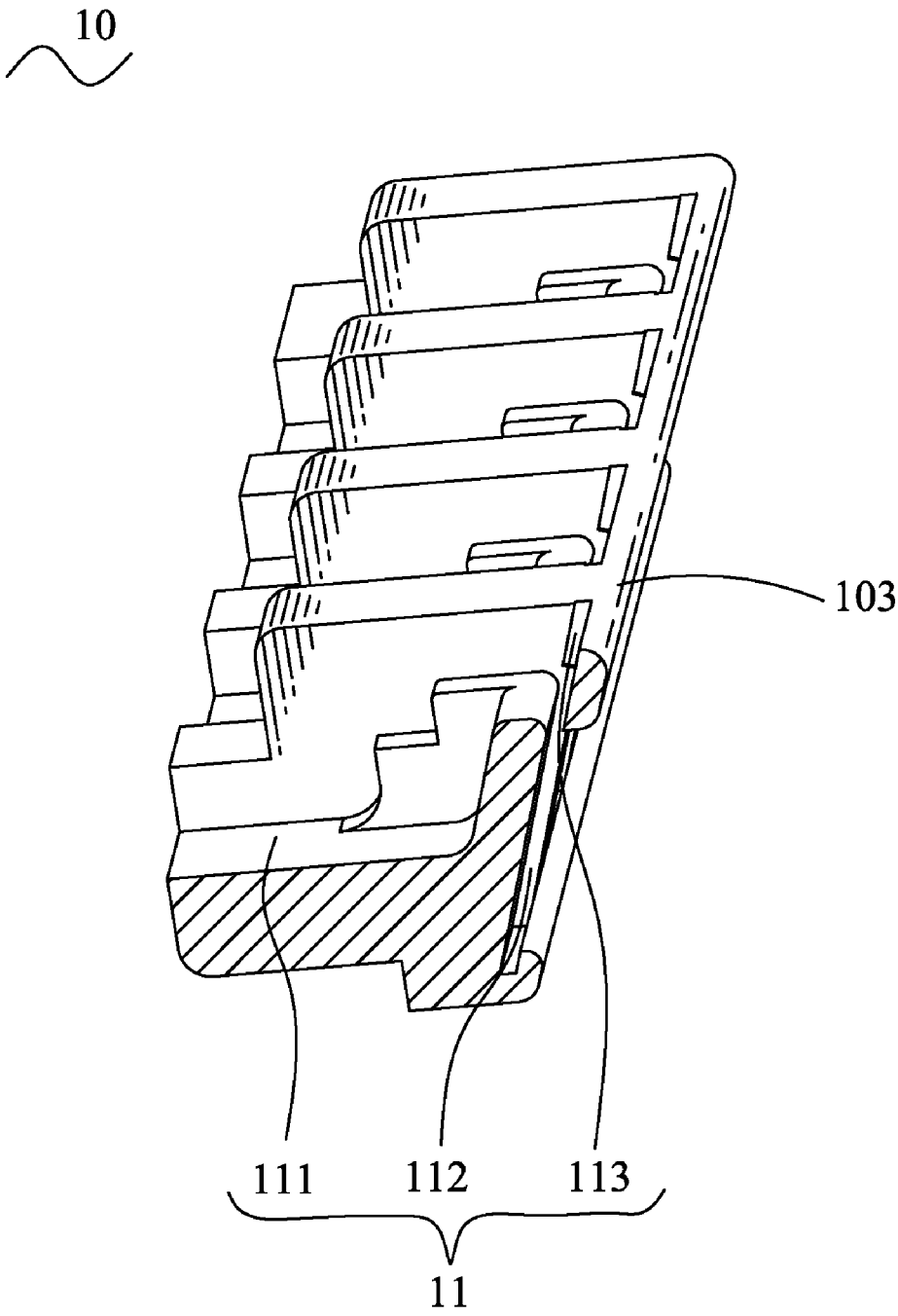
FIG. 3 is a sectional view of an insulating housing of the electrical connector of FIG. 2.
Figure 4:
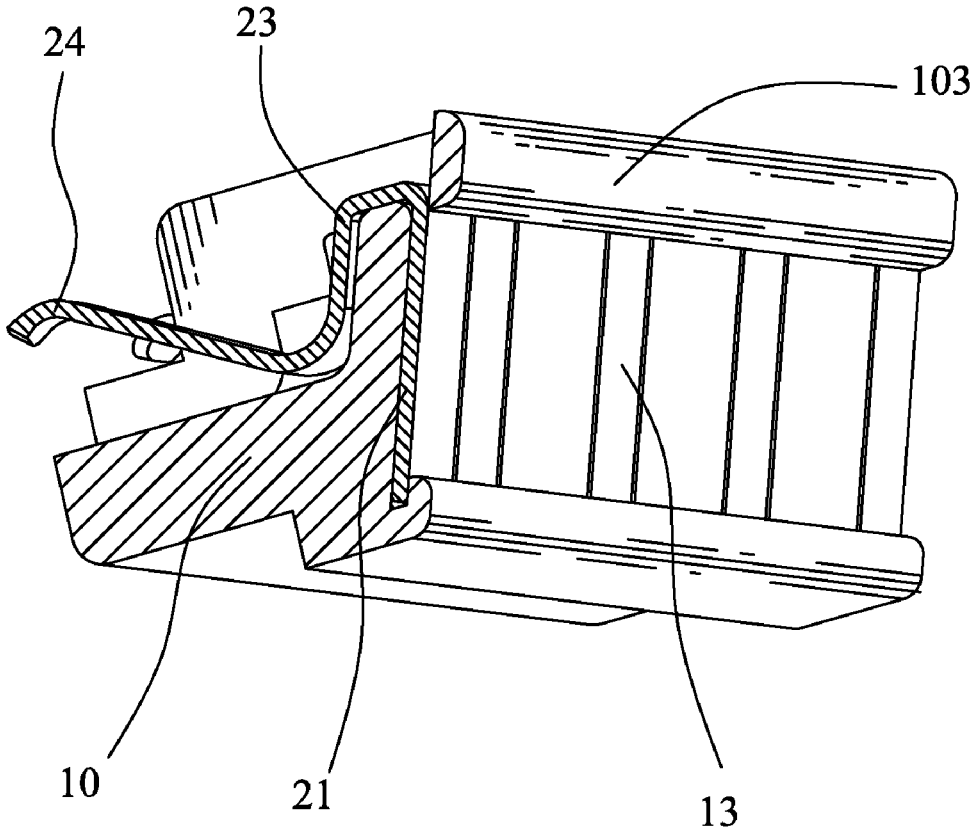
FIG. 4 is a sectional view of the electrical connector of FIG. 1.

Referring to FIGS. 2-4, the insulating housing 10 is of a substantially rectangular shape with a top surface 101, a front surface 102 perpendicular to the top surface 101, a rear surface 103 opposite to the front surface 102 and inclined forward from a top to a bottom of the insulating housing 10, and two opposite end surfaces 104. The insulating housing 10 defines a plurality of terminal passages 11 abreast spaced at regular intervals along a transverse direction thereof and each passing through the top surface 101 and the front surface 102. The terminal passage 11 includes a receiving groove 111 at a front thereof. A rectangular propping portion 15 protrudes upward from a rear of a bottom face 14 of the receiving groove 111 and is spaced a short distance from a rear wall 16 of the terminal passage 11 to define an inserting groove 112 therebetween. Two tops of two side faces 17 of the terminal passage 11 are oppositely concaved inward to form two buckling fillisters 113 adjacent to the rear wall 16, respectively. The receiving groove 111, the inserting groove 112 and the buckling fillisters 113 together define the terminal passage 11. Two lying L-shaped connecting blocks 12 are respectively protruded outward from the two end surfaces 104. A middle of the rear surface 103 is concaved forward to form a matching groove 13 extending transversely and communicating with the inserting grooves 112.

Referring to FIGS. 1-4 again, the terminals 20 are received in the corresponding terminal passages 11 of the insulating housing 10. Each of the terminals 20 has a rectangular base board 21 and a substantially V-shaped elastic portion 23 which has one arm connected with a middle of a top edge of the base board 21 by a connecting portion 25 to be spaced apart and face to the base board 21. The other arm of the elastic portion 23 extends forward oppositely to the base board 21 and is inclined upward. A free end of the other arm of the elastic portion 23 is arched upward to form a contact portion 24. Two ends of the top edge of the base board 21 extend upward to form two fastening portions 22 with two buckling protrusions 221 being oppositely protruded outward from outer sides thereof, respectively. The base board 21 is inserted downward into the inserting groove 112 and exposed to the matching groove 13. The connecting portion 25 is mounted on a top of the propping portion 15. The elastic portion 23 is received in the receiving groove 111 with a bottom thereof being substantially against the bottom face 14 of the receiving groove 111. The contact portion 24 is freely suspended in the front of the receiving groove 111. The fastening portions 22 abut against the rear wall 16 with the buckling protrusions 221 being buckled in the corresponding buckling fillisters 113 for preventing the base board 21 from swaying and further firmly restraining the terminal 20 in the insulating housing 10.

Figure 5:
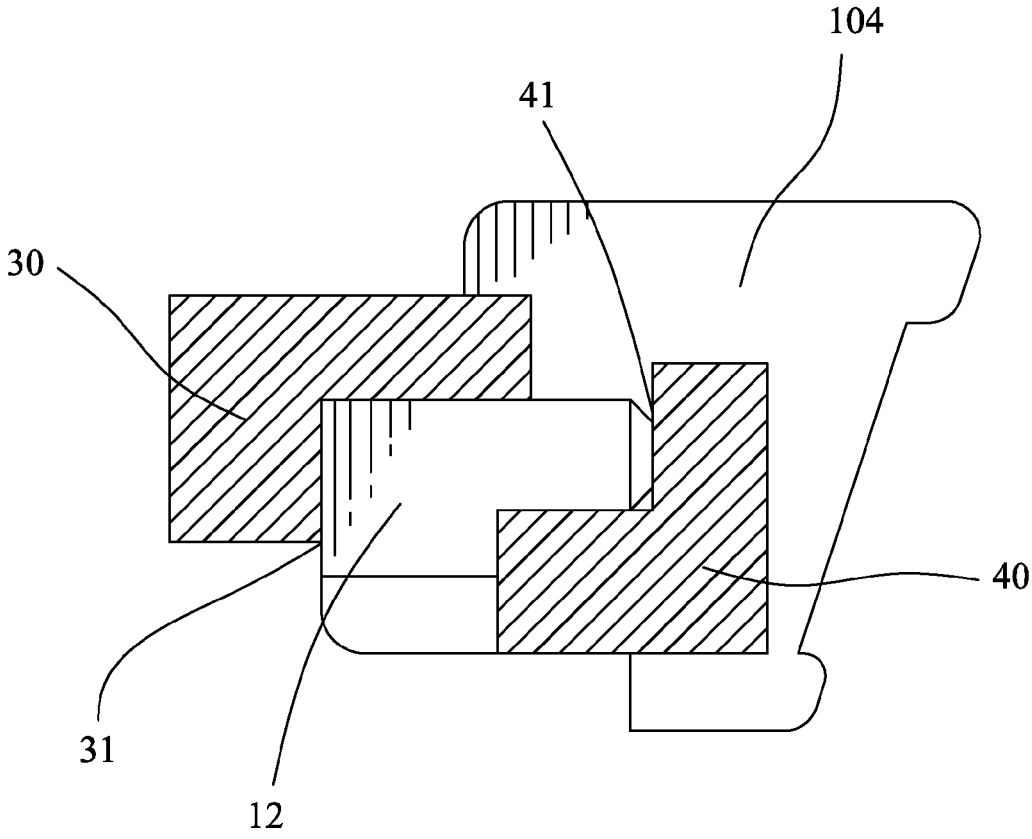
FIG. 5 is an assembled view showing that a connecting block of the insulating housing of the electrical connector of FIG. 1 is engaged with a first locating block and a second locating block of an electronic product.

Referring to FIG. 1 and FIG. 5, the electrical connector 1 is adapted to be used in an electronic product. The electronic product has two lying L-shaped first locating blocks 30 each defining a first containing mouth 31 between two arms of the first locating block 30, and two reversed L-shaped second locating blocks 40 each defining a second containing mouth 41 between two arms of the second locating block 40. The first containing mouth 31 substantially faces to the corresponding second containing mouth 41. When the electrical connector 1 is fastened to the electronic product, a front of each of the connecting blocks 12 is positioned in the first containing mouth 31 and a rear of each of the connecting blocks 12 is positioned in the second containing mouth 41 so that the connecting block 12 can be firmly clipped between the first locating block 30 and the corresponding second locating block 40. So the electrical connector 1 can be firmly mounted in the electronic product. A charging area (not shown) of the electronic product is assembled to the matching groove 13 so as to make an electrical connection with the base boards 21 of the terminals 20 of the electrical connector 1.

As described above, the base board 21 is inserted in the inserting groove 112 and the buckling protrusions 221 are buckled in the buckling fillisters 113 so that prevent the base board 21 swaying and further firmly restrain the terminal 20 in the insulating housing 10. Furthermore, the electrical connector 1 is firmly assembled to the electronic product directly by means of the clipping the connecting block 12 between the first locating block 30 and the corresponding second locating block 40. As a result, it simplifies an assembly process of the electrical connector 1 and the electronic product, and further lowers an assembly cost of the electrical connector 1.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector adapted to be mounted to an electronic product which has two lying L-shaped first locating blocks each defining a first containing mouth between two arms of the first locating block, and two reversed L-shaped second locating blocks each defining a second containing mouth between two arms of the second locating block, the first containing mouth substantially facing to the corresponding second containing mouth, the electrical connector comprising:

an insulating housing defining a plurality of terminal passages of which each includes a receiving groove at a front thereof, a propping portion being protruded upward from a rear of a bottom face of the receiving groove and spaced from a rear wall of the terminal passage to define an inserting groove therebetween, the insulating housing having two opposite end surfaces which oppositely protrude outward to form two lying L-shaped connecting blocks, a front of each of the connecting blocks being positioned in the first containing mouth and a rear of each of the connecting blocks being positioned in the second containing mouth so that the connecting block can be clipped between the first locating block and the corresponding second locating block to make the electrical connector mounted to the electronic product; and a plurality of terminals received in the terminal passages of the insulating housing respectively, each terminal having a base board, a substantially V-shaped elastic portion of which one arm is connected with a top edge of the base board and apart faces to the base board, and a contact portion arched upward from a free end of the other arm of the elastic portion, wherein the elastic portion is received in the receiving groove, the base board is inserted in the inserting groove to electrically connect with the electronic product, the propping portion is located between the base board and the elastic portion.

2. The electrical connector as claimed in claim 1, wherein two tops of two side faces of the terminal passage are oppositely concaved inward to form two buckling fillisters adjacent to the rear wall of the terminal passage, two ends of the top edge of the base board extend upward to form two fastening portions with two buckling protrusions being oppositely protruded outward from outer sides thereof, the fastening portions abut against the rear wall and the buckling protrusions are buckled in the buckling fillisters respectively.

3. The electrical connector as claimed in claim 2, wherein the elastic portion is connected with the top edge of the base board by a connecting portion substantially perpendicular to the base board which is mounted across a top of the propping portion.

4. The electrical connector as claimed in claim 1, wherein the insulating housing has a rear surface, a middle of the rear surface is concaved forward to form a matching groove for receiving a corresponding portion of the electronic product therein, the inserting grooves communicates with the matching groove so as to make the base boards exposed to the matching groove and further electrically connect with the electronic product.

* * * * *